US010096398B2

(12) United States Patent
Janah et al.

(10) Patent No.: US 10,096,398 B2
(45) Date of Patent: Oct. 9, 2018

(54) ELECTRICAL CABLE THAT IS RESISTANT TO PARTIAL DISCHARGES

(75) Inventors: Hakim Janah, Coulogne (FR); Thiery Daumand, Guignen (FR); Virak Phul, Wissous (FR); Patrick Rybski, Yerres (FR); Pascal Clouet, Draveil (FR); Wilfried Lecluse, Saint-Cyr-l'Ecole (FR); Rui Manuel Da Silva, Chilly-Mazarin (FR)

(73) Assignee: NEXANS, Courbevoie (FR)

( * ) Notice: Subject to any disclaimer, the term of this patent is extended or adjusted under 35 U.S.C. 154(b) by 0 days.

(21) Appl. No.: 13/568,412

(22) Filed: Aug. 7, 2012

(65) Prior Publication Data

US 2013/0206452 A1 Aug. 15, 2013

(30) Foreign Application Priority Data

Aug. 9, 2011 (FR) ..... 11 57253

(51) Int. Cl.

| | |
|---|---|
| ***H01B 7/00*** | (2006.01) |
| ***H01B 3/44*** | (2006.01) |
| ***H01B 3/00*** | (2006.01) |
| ***H01B 3/30*** | (2006.01) |
| ***H01B 7/28*** | (2006.01) |
| *H01B 7/02* | (2006.01) |

(52) U.S. Cl.

CPC ..... *H01B 3/445* (2013.01); *H01B 3/004* (2013.01); *H01B 3/306* (2013.01); *H01B 7/2813* (2013.01); *H01B 7/0216* (2013.01)

(58) Field of Classification Search

CPC ..... H01B 3/004; H01B 3/306; H01B 3/445; H01B 7/0216; H01B 7/2813

USPC ..... 174/120 SC

See application file for complete search history.

(56) References Cited

U.S. PATENT DOCUMENTS

| | | | | |
|---|---|---|---|---|
| 3,660,592 | A * | 5/1972 | Anderson | 174/114 R |
| 4,469,538 | A * | 9/1984 | Wade et al. | 156/51 |
| 4,469,539 | A * | 9/1984 | Wade et al. | 156/51 |
| 4,532,375 | A * | 7/1985 | Weitzel et al. | 174/107 |
| 4,588,855 | A * | 5/1986 | Kutsuwa et al. | 174/120 SC |
| 5,220,133 | A * | 6/1993 | Sutherland et al. | 174/120 R |
| 5,245,134 | A * | 9/1993 | Vana et al. | 174/117 F |
| 5,326,935 | A * | 7/1994 | Yamaguchi et al. | 174/120 R |
| 5,362,925 | A * | 11/1994 | Yamaguchi et al. | 174/120 R |
| 7,253,357 | B2 * | 8/2007 | Cipelli et al. | 174/36 |
| 7,750,246 | B2 * | 7/2010 | Ferlier et al. | 174/120 R |

(Continued)

FOREIGN PATENT DOCUMENTS

| | | | | |
|---|---|---|---|---|
| WO | WO 01/18824 | A1 * | 3/2001 | H01B 3/44 |
| WO | WO 0118824 | A1 * | 3/2001 | H01B 3/445 |
| WO | 02084674 | | 10/2002 | |

OTHER PUBLICATIONS

International Search Report dated Mar. 5, 2012.

*Primary Examiner* — Timothy Thompson
*Assistant Examiner* — Rhadames J Alonzo Miller
(74) *Attorney, Agent, or Firm* — Sofer & Haroun, LLP

(57) ABSTRACT

An electrical cable (1) is provided having (1) a conductive element (2), a first layer (3) having polyimide (PI) surrounding said conductive element (2), a second fluorinated layer (4) having at least one fluorinated compound, surrounding the first layer, and optionally at least one fluorinated semiconductor layer having at least one fluorinated compound, where the total thickness of the assembly of fluorinated layers is at least 0.4 mm.

15 Claims, 2 Drawing Sheets

(56) References Cited

U.S. PATENT DOCUMENTS

| | | | | |
|---|---|---|---|---|
| 8,013,251 | B2 * | 9/2011 | Bhandari et al. | 174/110 SR |
| 2003/0062190 | A1 * | 4/2003 | Kim et al. | 174/149 R |
| 2005/0013998 | A1 * | 1/2005 | Lacourt | B32B 7/12 428/377 |
| 2005/0016757 | A1 * | 1/2005 | Schwamborn et al. | 174/120 R |
| 2009/0250243 | A1 * | 10/2009 | Zhu et al. | 174/120 R |
| 2010/0218975 | A1 * | 9/2010 | Mehan | 174/120 SR |

* cited by examiner

ELECTRICAL CABLE THAT IS RESISTANT TO PARTIAL DISCHARGES

RELATED APPLICATION

This application claims the benefit of priority from French Patent Application No. 11 57253, filed on Aug. 9, 2011, the entirety of which is incorporated by reference.

BACKGROUND

Field of the Invention

The present invention relates to an electrical cable, and applies typically, but not exclusively, to the electrical cables used in aeronautics, for example on board aeroplanes.

Description of the Related Art

This type of electrical cable must satisfy numerous criteria necessary for its use in aeronautics, especially when it is subjected to high voltages, of the order of 230 V, and for cables located in the non-pressurized areas.

This relatively high voltage, combined with aeronautical constraints, such as humidity, high temperature and low pressure, may give rise to partial discharges (PD) on electronic equipment, such as electrical cables. Now, partial discharges, which are minute electric arcs in the material insulating the cable, bring about over time degradation of the insulating material, which can lead to rupture of the dielectric.

Other criteria may also be taken into consideration, for instance the weight and diameter of said cable, which must not be excessive, and the markability of said cable in order to enable its identification, when necessary.

In the prior art, it is known practice to equip aeroplanes with hook-up wires, these wires comprising: a conductive element surrounded by a first layer made of polyimide from 0.017 to 0.065 mm thick, which is itself surrounded with a layer made of polytetrafluoroethylene PTFE from 0.1 to 0.22 mm thick for nominal conductive cross sections ranging from 0.15 to 95 $mm^2$. However, for such hook-up wires, the applied voltage is of the order of 115 V.

Document EP 1 498 909 concerns a multilayer composition whose function is to insulate and/or protect electrical conductive materials, such as cables for aeronautics. This insulating composition successively comprises around the electrical element to be protected a first layer made of polyimide (PI), a second layer made of perfluoro(alkyl vinyl ether)/tetrafluoroethylene copolymer (PFA) and optionally an outer layer made of polytetrafluoroethylene (PTFE). The thickness of the PI layer ranges from 8 to 150 μm and the thickness of the PTFE ranges from 1 to 200 μm. However, the resistance to partial discharges of a cable surrounded with this composition is not optimized for high voltages either, such as 230 V.

OBJECTS AND SUMMARY OF THE INVENTION

The aim of the present invention is to propose a novel cable that avoids all or some of the abovementioned drawbacks. In particular, the aim of the present invention is to provide a cable that is resistant to partial discharges, especially when the cable is intended for aeronautics and is subjected during flight to high temperatures (of about 150° C.) and low pressures (about 150 mbar).

To this end, one subject of the present invention is an electrical cable comprising:

- a conductive element, preferably elongated, and even more preferably central,
- a first layer comprising polyimide (PI) surrounding said conductive element,
- a second fluorinated layer comprising a fluorinated compound, surrounding said first layer, and
- optionally at least one fluorinated semiconducting layer which may comprise at least one fluorinated compound, the fluorinated compound included in said semiconducting layer especially being identical to or different than that included in the second fluorinated layer, and
- optionally at least one fluorinated adhesive layer which may comprise at least one fluorinated compound, the fluorinated compound included in said adhesive layer especially being identical to or different than that included in the second fluorinated layer, characterized in that the total thickness of the assembly of fluorinated layers is at least 0.4 mm and preferably at least 0.5 mm.

More particularly, the fluorinated compound may be a fluorinated polymer (or copolymer) and may preferably be chosen from: polytetrafluoroethylene (PTFE), poly(tetrafluoroethylene-co-hexafluoropropylene) (FEP), perfluoro (alkyl vinyl ether)/tetrafluoroethylene (PFA) copolymer, and poly(ethylene-co-tetrafluoroethylene) (ETFE), or a combination thereof.

It has been demonstrated, surprisingly, that said total thickness of the assembly of fluorinated layers of at least 0.4 mm within the various layers of the cable makes it possible to increase the resistance of said cable to partial discharges, irrespective of the diameter of the cable.

The term "total thickness of the assembly of fluorinated layers" means

- either the thickness of the second (fluorinated) layer, which may especially comprise PTFE, PFA, ETFE and FEP or a combination thereof, which is at least 0.4 mm,
- or the thickness of this second (fluorinated) layer cumulated with the thickness of other optional fluorinated layers comprising at least one fluorinated compound especially such as PTFE, PEA, ETFE and FEP or a combination thereof, these optional fluorinated layers may be said fluorinated semiconducting layer and/or said fluorinated adhesive layer, and/or any other optional fluorinated layers (e.g.: marking layer) comprising at least one fluorinated compound defined in the invention, the total thickness of the assembly of these layers, comprising one or more fluorinated compounds, especially such as PTFE, PFA, ETFE and FEP or a combination thereof, being at least 0.4 mm.

Preferably, a layer is said to comprise at least one fluorinated compound when it comprises, on a weight basis relative to the weight of said layer, at least 50% of fluorinated compound(s), preferably at least 70% of fluorinated compound(s) and even more preferably at least 80% of fluorinated compound(s) and even more preferably 90% of fluorinated compound(s), especially such as PTFE, PFA, ETFE or FEP, or a combination thereof.

Advantageously, the fluorinated compound is PTFE.

Preferentially, the total thickness of the assembly of fluorinated layers, for instance PTFE, PTFA, ETFE or FEP or a combination thereof, after sintering, is at least 0.5 mm and preferably 0.56 mm, whereas the maximum total thickness of the assembly of fluorinated layers, for instance PTFE, PFA, ETFE or FEP or a combination thereof, will advantageously be in the region of 0.7 mm. Thus, the thickness, especially the maximum thickness, of the assembly of fluorinated layers, will depend on the intended volume for the hook-up in the aeroplane.

According to the invention, the second fluorinated layer (e.g. PTFE, PFA, ETFE or FEP) may be in tape and/or extruded form.

When it is in tape form, the second layer may correspond to the winding of one or more tapes of fluorinated compound (s) (e.g. PTFE (cf.: Example 2), PFA, ETFE or PEP, or a combination thereof). It is then sintered in order to give it its mechanical properties.

Preferentially, the second layer comprises one or more tapes of fluorinated compound(s), preferably one or more tapes of PTFE, covered with an extruded layer of one of said fluorinated compounds (e.g. PTFE, PEA, FEP, ETFE, or a combination thereof, preferably PFA, FEP or ETFE).

In particular, the second layer is partially or totally sintered, preferably totally sintered.

According to one embodiment variant, the first layer of PI and the second fluorinated layer (e.g. PTFE) are separated by an adhesive layer or a semiconducting layer or a combination thereof.

Advantageously, the semiconducting layer is arranged at the surface around the second layer, or between the first and the second layer, or between the conductive element and the first layer, or a combination thereof.

The semiconducting layer is in the form of a tape, an extrudate or a varnish, or a combination thereof. According to the invention, a layer is more particularly considered to be semiconducting when its electrical conductivity is at least 0.001 $S \cdot m^{-1}$ (siemens per meter).

In particular, when the semiconducting layer is in the form of a tape or extrudate, it may be composed of fluorinated polymer or copolymers (cf. fluorinated semiconducting layer) comprising, on a weight basis relative to the total weight of said semiconducting layer, from 0.1% to 40% of (electrically) conductive filler.

When the semiconducting layer is in the form of a varnish, it may be composed of fluorinated components, of the FEP or PFA or PTFE dispersion type comprising, on a weight basis relative to the total weight of said semiconducting layer, from 0.1% to 40% of (electrically) conductive filler.

Preferably, the semiconducting layer(s) may comprise at least 10% by weight of electrically conductive filler and even more preferentially at least 25% by weight of electrically conductive filler relative to the total weight of said semiconducting layer. The electrically conductive filler may be advantageously chosen from carbon blacks, carbon nanotubes, or a mixture thereof.

According to one characteristic of the invention, the semiconducting layer has a longitudinal resistivity of from 0.04 to 1.00 ohm·m and preferably from 0.06 to 0.6 ohm·m.

Preferentially, the first polyimide layer ranges from 0.015 mm to 0.1 mm and is preferably from about 0.030 to 0.075 mm and even more preferentially about 0.060 mm. This first layer comprising polyimide may be made by taping (winding a polyimide tape) or by coating with varnish (mixture of components that polymerize in situ), according to techniques known to those skilled in the art.

Advantageously, at least one adhesive layer is arranged on: at least one of the two faces of the first layer comprising polyimide, or between the conductive element and the semiconducting layer when the latter layer is between the conducting element and the first layer, or a combination thereof. An adhesive layer has the function of enabling adhesion between the layers that it connects or between the conductive element and the layer that it connects.

According to one characteristic of the invention, the adhesive layer(s) are composed of one or more fluorinated polymers. Such a layer is then referred to as a fluorinated adhesive layer.

In particular, the fluorinated polymer (s) of the adhesive layer are chosen from: poly(tetrafluoroethylene-co-hexafluoropropylene) (FEP), perfluoro(alkyl vinyl ether)/tetrafluoroethylene (PFA) copolymer, polytetrafluoroethylene (PTFE) and poly(ethylene-co-tetrafluoroethylene) (ETFE), or a combination thereof, said fluorinated compounds having adhesive properties. Specifically, they are suitable for adhering the conductive element to the first layer (PI layer) or the PI layer to the second layer (e.g. layer of PTFE, PFA, FEP, ETFE, or a combination thereof). Specifically, the fluorinated polymer(s) of the adhesive layer undergo a pretreatment that gives them their adhesive property, as is the case for the product Kapton FN® sold by the company DuPont.

For example, the first polyimide layer may be coated on one of its faces with a coating of fluorinated ethylene-propylene copolymer (FEP) as adhesive layer. The product Kapton FN® is suitable for use in the present invention. It is in the form of a tape. The thickness of FEP per face is, in this case, 2.5 μm and the thickness of PI is 25.4 μm. The PI layer in the cable is thus obtained by winding at least two thicknesses of tape so that there is overlap, producing a thickness of PI layer of about 0.05 mm and a thickness of PI layer with adhesive layers (Kapton FN® product) of about 0.06 mm.

Preferably, the ratio of the thickness of the second layer (for example a layer of PTFE) to the PI layer ranges from 4 to 22 and preferably from 7.5 to 12, for nominal conducting cross sections ranging from 0.15 to 95 $mm^2$.

The conductive element that is suitable for use according to the invention is, for example, of the bulk or stranded type and may correspond to: copper (Cu), to a tin-copper alloy, to a silver-copper alloy, to a nickel-copper alloy, to nickel-plated aluminum (Al), or to nickel-plated copper-clad aluminum.

In another embodiment, the electrical cable also comprises an outer (surface) layer that can be marked. This layer may be a tape or an extrudate of fluorinated polymer or a fluorinated varnish (for instance made of PTFE, FEP, PFA, ETFE or a mixture thereof) comprising pigments of metal complex type.

The cable comprising the abovementioned characteristics is intended to be used in the aeronautics field and is especially intended to equip aeroplanes.

BRIEF DESCRIPTION OF THE DRAWINGS

For better understanding of the invention, the description will make reference to the attached drawings, which are given merely as non-limiting illustrations.

In these drawings.

DETAILED DESCRIPTION

Implementation Examples

Example 1: Example of Composition of a Cable According to the Invention (FIG. 1)

Figure 1:
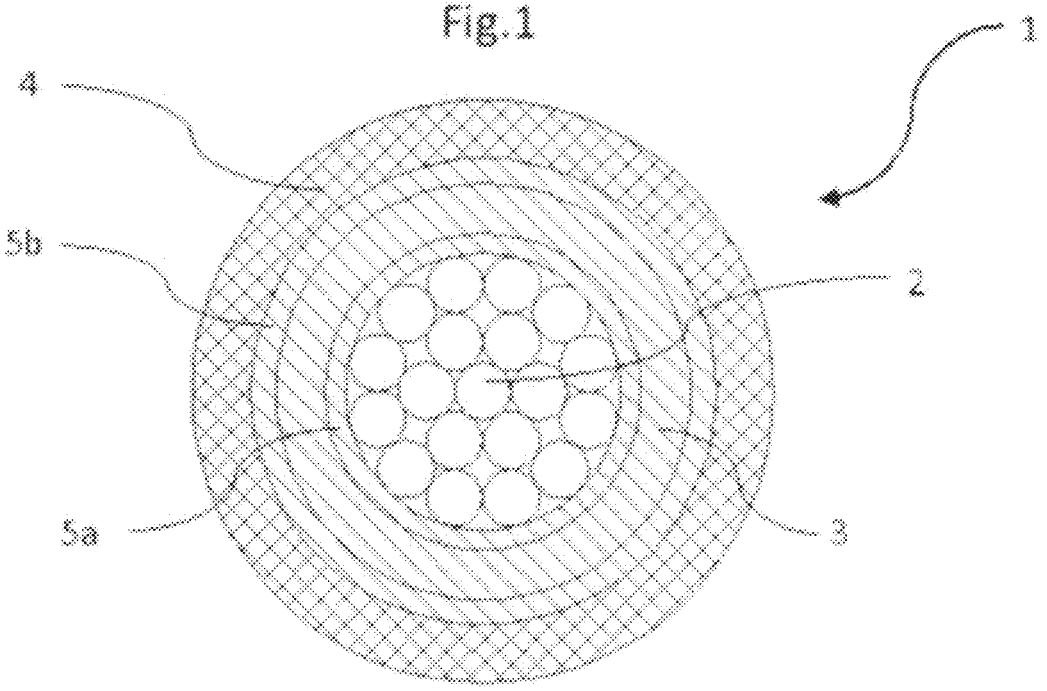
FIG. 1 is a view in cross section of an electrical cable at the insulation stage (without sheath) according to one preferred embodiment of the invention.

For reasons of clarity, only the elements that are essential for understanding the invention have been represented schematically, without being to scale, in FIG. 1.

According to a first embodiment, the hook-up wire or the power cable 1, represented in FIG. 1, comprises: a central conductive element 2, especially made of copper or aluminum, of multistrand type, and, successively and coaxially around this element, a first adhesive layer made of FEP 5*a*, a layer of polyimide PI 3 known as the "first layer", a second adhesive layer 5*b* and a PTFE layer 4, known as the second layer, representing here the outer layer of the cable 1. The various layers are obtained by taping. The cable is then heat-treated in order to sinter the PTFE outer layer. To do this, a temperature above 340° C. is applied.

In this example, the thickness of PI is 0.058 mm and the thickness of the PTFE second layer after sintering is about 0.56 mm, such that the ratio PTFE/PI=0.56/0.058=9.65.

Example 2: Process and Another Composition of a Cable According to the Invention According to another embodiment, an electrical cable comprises an electrical, conductor, for example made of copper or copper alloy coated with a layer of nickel, generally of multistrand type.

Said electrical conductor is covered with an adhesive FEP layer, which is itself covered with a PI layer, which is itself covered with another adhesive FEP layer. This FEP/PI/FEP assembly preferably corresponds to the tape Kapton FN® from DuPont comprising a layer of PI 25.1 μm thick coated on each of its faces with a layer of FEP 2.5 μm thick.

The FEP/PI/FEP assembly is then surrounded by a layer, comprising a winding of three PTFE tapes: a first PTFE tape having a thickness before sintering of about 180 μm, a second PTFE tape having a thickness before sintering of about 180 μm and a third PTFE tape which advantageously comprises a pigmented PTFE layer (3%) and has a thickness before sintering of about 76 μm. The pigment of the third PTFE tape is a metal complex. This allows marking by UV laser of the surface of the outer layer of said third tape. Generally, the pigments do not represent more than 5% by weight of said third tape. It is preferable not to exceed this value of 5%, or even to minimize it so as not to degrade the electrical properties of the cable.

After laying (or taping) of the first PTFE tape, the electrical conductor thus insulated is heat-treated in an oven at a temperature above the melting point of the PTFE, namely at a temperature above 340° C., to obtain sintering of the PTFE. Via this single heat-treatment step, which comprises the step of heat-welding of the polyimide and the step of sintering of the PTFE, the adhesion of all the thicknesses of tapes is ensured. Specifically, the heat treatment leads to the cohesion of the PTFE tape on the PI tape and the bonding of the PI tape to itself and to the conductive element.

After this baking step, the second and then the third tape are laid.

Next, the step of marking of the third tape (UV laser marking) is performed according to techniques known to those skilled in the art.

Finally, a second heat treatment at a temperature above 340° C. is performed, so as to sinter the second and third PTFE tapes (i.e. the tapes laid after the first heat treatment). The various heat-treatment steps are generally performed in an oven or an array of ovens.

After baking, the total thickness of the PTFE layer is about 0.68 mm.

Next, the cable is advantageously covered with a metal shield (braiding of metal wires) and a composite sheath. The latter two elements are known to those skilled in the art.

Figure 2:
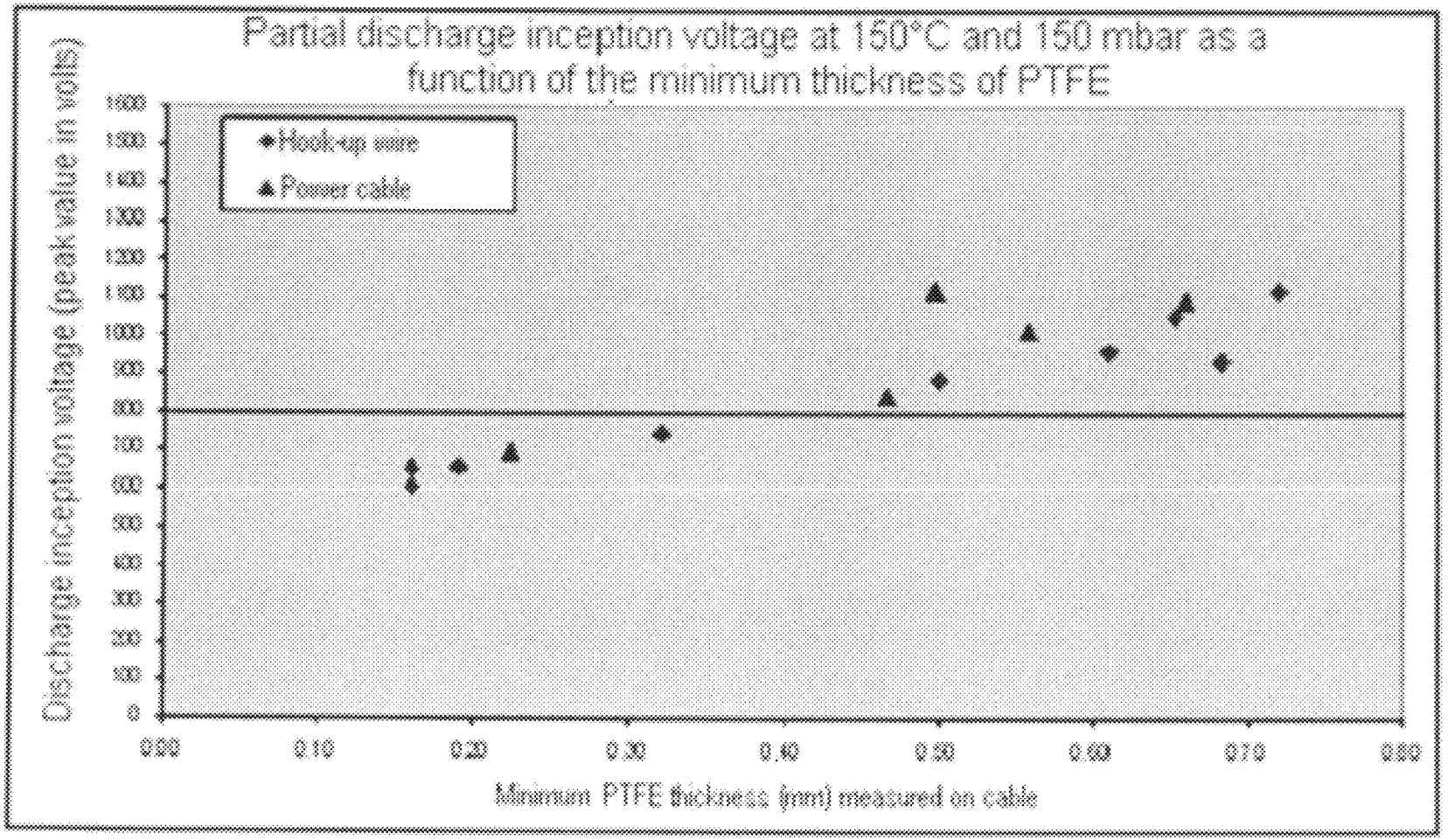
FIG. 2 is a graph showing the discharge inception voltage (PDIV) at 150° C. for a pressure of 150 mbar as a function of the thickness in millimeters of the second PTFE layer and for various types of cable, and of nominal conductive cross sections from 0.95 to 70 $mm^2$.

Example 3: Test of Resistance of Cables Obtained According to Example 2 for Various Thicknesses of PTFE and Various Nominal Cross Sections of Conductors (FIG. 2)

The discharge inception voltage was measured for various cables. These cables were prepared according to the process of Example 2. The first heat treatment takes place after laying the first tape and the second and final heat treatment takes place after laying the last tape. The characteristics of the cables at the insulation stage (without metal braiding and sheath) according to the invention are represented in the table below:

The mean thickness of Kapton FN® represents the thickness measured on the cable once manufactured, whereas the thickness of the PTFE tapes corresponds to the thickness of the PTFE tapes used (before manufacture of the cable) and the cumulative thickness corresponds to the thickness measured once the cable has been manufactured.

| Ex. | Nature of the conductor/ nominal cross section ($mm^2$) | Mean thickness of Kapton FN ® (mm) | Thicknesses of PTFE tapes (μm) 1 | 2 | 3 | 4 | 5 | 6 | Cumulative PTFE thickness (mm) |
|---|---|---|---|---|---|---|---|---|---|
| 1 | NPC/0.95 | 0.060 | 64 | 64 | | | | | 0.19 |
| 2 | NPC/0.95 | 0.060 | 76 | 76 | 76 | 76 | | | 0.50 |
| 3 | NPC/0.95 | 0.060 | 76 | 76 | 76 | 76 | 76 | 76 | 0.72 |
| 4 | NPC/1.45 | 0.062 | 100 | 100 | | | | | 0.32 |
| 5 | NPC/1.45 | 0.062 | 100 | | | | | | 0.16 |
| 6 | NPC/1.45 | 0.069 | 100 | 76 | 76 | 76 | 76 | | 0.653 |
| 7 | NPC/4.1 | 0.062 | 100 | 76 | 76 | 76 | 76 | | 0.61 |
| 8 | NPC/4.1 | 0.062 | 100 | | | | | | 0.16 |
| 9 | NPC/6.6 | 0.069 | 180 | 180 | 76 | | | | 0.683 |
| 10 | NPA/27.1 | 0.076 | 76 | 76 | | | | | 0.224 |
| 11 | NPA/27.1 | 0.074 | 180 | 100 | | | | | 0.466 |
| 12 | NPA/27.1 | 0.058 | 180 | 180 | 76 | | | | 0.557 |
| 13 | NPA/42.9 | 0.060 | 180 | 180 | 76 | | | | 0.497 |
| 14 | NPA/70 | 0.056 | 130 | 180 | 76 | | | | 0.659 |

Examples 1 to 9 are hook-up wires and Examples 10 to 14 are power cables.
NPC: nickel-plated copper
NPA: nickel-plated aluminum For each sample of 1000±5 mm, a cable loop is made. The diameter of the loop is between 8 and 12 times the outside diameter of the cable.

The cable braiding is undone over about 5 mm to allow it to be connected to the earth.

The cable loop is positioned in an oven configured so as to allow the application of a vacuum, a voltage and connection to the measuring system (oscilloscope).

When the temperature and negative pressure conditions have been reached and stabilized, a 50 Hz alternating voltage is applied between the conductor and the braid.

The voltage is increased by 50 volts/s up to the inception of partial discharges. The corresponding voltage (partial discharges inception voltage) is recorded.

One of the functionalities of the oscilloscope makes it possible to count the number of discharges exceeding a predefined gauge (5 pC).

The definition of the partial discharge inception voltage is that voltage that is reached when at least one discharge per second takes place over a period of 30 seconds.

The voltage is then increased by 100 volts above the PDIV before redescending in order to determine the partial discharge extinction voltage, which is defined by the oscilloscope as the voltage at which the last discharge was detected.

As shown by graph 2, the cables have a cumulative thickness of layers comprising PTFE of greater or equal to 0.4 mm, can withstand a higher discharge inception voltage (PDIV) than cables with a total thickness of layers comprising PTFE of less than 0.4 mm, irrespective of the cross section of the conductor or of its nature. A PDIV limit above 800 V, the peak value, which is the minimum voltage without discharges currently experienced for the application of 230 V of hook-up wires and power cables, was considered.

These tests thus show that a thickness of layer(s) comprising PTFE of at least 0.4 mm makes it possible to obtain cables that show good resistance to partial discharges at a high temperature of 150° C. and at a low pressure of 150 mbar.

Although the invention has been described in connection with a particular embodiment, it is obvious that it is not in any way limited thereto and that it includes all the technical equivalents of the means described and also combinations thereof if they fall within the context of the invention.

The invention claimed is:

1. Electrical cable comprising:

a conductive element having a nominal cross section in the range of 0.95 $mm^2$ to 70 $mm^2$;

a first layer comprising polyimide (PI) surrounding said conductive element;

a second fluorinated layer of polytetrafluoroethylene (PTFE) surrounding said first layer; and optionally at least one fluorinated semiconductor layer comprising at least one fluorinated compound, wherein the total thickness of the assembly of PTFE layers is at least 0.4 mm, and that the thickness ratio of the fluorinated layer(s) to the PI layer ranges from 4 to 22, and wherein the combination of the materials selected for said first layer of PI, said second fluorinated layer, and optionally at least one fluorinated semiconductor layer and the nominal cross section in the range of 0.95 $mm^2$ to 70 $mm^2$ of said conductive element are such that the combined insulations layers results provide said cable with a partial discharge inception voltage above 800 volts.

2. Electrical cable according to claim 1, wherein the total thickness of the assembly of fluorinated layers is at least 0.5 mm.

3. Electrical cable according to claim 1, in which the fluorinated compound is PTFE.

4. Electrical cable according to claim 1, in which the second layer is in the form of one or more tapes and of extrudate, or a combination thereof.

5. Electrical cable according to claim 4, in which the second layer comprises one or more PTFE tapes, covered with an extruded layer of one of said fluorinated compounds.

6. Cable according to claim 1, in which the second layer is totally sintered.

7. Electrical cable according to claim 1, in which said semiconductor layer is positioned at the surface around the second layer, or between the first layer and the second layer, or between the conductive element and the first layer, or a combination thereof.

8. Electrical cable according to claim 1, in which the semiconductor layer is in the form of a tape, an extrudate or a varnish, or a combination thereof.

9. Electrical cable according to claim 8, wherein, when the semiconductor layer is in the form of a tape or an extrudate, said semiconductor layer is composed of fluorinated polymer or copolymers comprising, on a weight basis relative to the total weight of said semiconductor layer, from 0.1% to 40% of (electrically) conductive filler.

10. Electrical cable according to claim 8, wherein, when the semiconductor layer is in the form of a varnish, said semiconductor layer is composed of fluorinated components comprising, on a weight basis relative to the total weight of said semiconductor layer, from 0.1% to 40% of (electrically) conductive filler.

11. Electrical cable according to claim 1, wherein the semiconductor layer has a longitudinal resistivity of from 0.04 to 100 ohm·m.

12. Electrical cable according to claim 1, wherein the thickness of the first layer ranges from 0.028 mm to 0.1 mm.

13. Electrical cable according to claim 1, wherein at least one adhesive layer is arranged on: at least one of the two faces of the first layer, or between the conductive element and the semiconductor layer when said adhesive layer is between the conductive element and the first layer, or a combination thereof.

14. Electrical cable according to claim 13, wherein the adhesive layer is composed of one or more fluorinated polymers.

15. Electrical cable according to claim 14, wherein the fluorinated polymer(s) of the adhesive layer are selected from the group consisting of: poly(tetrafluoroethylene-co-hexafluoropropylene) (FEP), perfluoro(alkyl vinyl ether)/tetrafluoroethylene (PFA), polytetrafluoroethylene (PTFE), and poly(ethylene-co-tetrafluoroethylene) (ETFE), or a combination thereof, the abovementioned fluorinated compounds having adhesive properties.

* * * * *